United States Patent [19]

Platek

[11] 3,964,115

[45] June 22, 1976

[54] ADJUSTABLE JAR CAP ROTATOR INCLUDING IN COMBINATION CAN PERFORATOR AND BOTTLE OPENER

[76] Inventor: Stanley F. Platek, 187 Maplewood Ave., Maplewood, Essex County, N.J. 07040

[22] Filed: Aug. 26, 1974

[21] Appl. No.: 500,462

[52] U.S. Cl. ..... 7/14.25; 81/3.43; 81/64

[51] Int. Cl.[2] ..... B67B 7/44

[58] Field of Search ..... 7/14.2 R, 14.25, 14.6; 81/3.43, 64

[56] References Cited

UNITED STATES PATENTS

| | | | |
|---|---|---|---|
| 1,266,510 | 5/1918 | McMeekin | 81/3.43 |
| 1,505,017 | 8/1924 | Fornelius | 81/3.43 |
| 1,513,164 | 10/1924 | Euverard | 81/3.43 |
| 2,013,209 | 9/1935 | Hargreaves | 81/64 |
| D167,920 | 10/1952 | Zuras | 7/14.25 |

FOREIGN PATENTS OR APPLICATIONS

| | | | |
|---|---|---|---|
| 485,048 | 10/1928 | Germany | 81/64 |

*Primary Examiner*—Al Lawrence Smith
*Assistant Examiner*—Roscoe V. Parker
*Attorney, Agent, or Firm*—Anthony F. Cuoco

[57] ABSTRACT

A device of the type described includes a base having an arcuate serrated member for engaging a portion of a jar cap, and a flexible friction type member such as a strap or the like is adjustably arranged with the base and a spring biased handle. Operation of the handle as by squeezing tightens the strap around the cap, whereupon a gripping action is provided by the strap and the arcuate serrated member so that an operator exerted torquing or twisting action rotates the cap. The base may carry at one end thereof a can perforator and at the other end a bottle opener.

10 Claims, 5 Drawing Figures

ADJUSTABLE JAR CAP ROTATOR INCLUDING IN COMBINATION CAN PERFORATOR AND BOTTLE OPENER

BACKGROUND OF THE INVENTION

1. Field of the Invention

This invention relates generally to an adjustable jar cap rotator and particularly to a device of the type described such as may be used for household purposes. More particularly, this invention relates to a household type article including in combination a jar cap rotator, a can perforator and a bottle opener.

2. Description of the Prior Art

Apparatus of the type described for mechanically rotating jar caps has heretofore been cumbersome and difficult to operate so as not to be particularly adaptable for household purposes. A typical prior art device is described in U.S. Pat. No. 3,812,742 issued on May 28, 1974, wherein a frame and clamping apparatus is provided in combination to accomplish this task. Devices of this type are difficult to use and are not of the typical household variety. The present invention is an easy to use jar cap rotator, and includes in combination therewith a can perforator and a bottle opener so as to provide a household article which finds utility in a wide variety of household chores.

SUMMARY OF THE INVENTION

This invention contemplates a device of the type described including a base having an arcuate serrated member at one end thereof for engaging a portion of the periphery of a jar cap. A flexible element of indeterminant length such as a strap or the like has one end supported by the base and the other end threaded through a spring biased handle and through the base to form an adjustable loop. The strap loop has a friction surface which surrounds the jar cap and is drawn taut around said cap upon operator-operation of the handle as by squeezing, whereupon the friction surfacec and serrations on the arcuate member cooperate to provide a gripping action so that an operated exerted torquing or twisting action rotates the cap. One end of the base carries a conventional type can perforator while the other end carries a likewise conventional type bottle opener to provide in combination the device described. The jar cap rotating feature of the invention may be used for removing jar caps as may be desired, and may be used as well for tightly replacing said caps on the jars as may be required for storing food stuffs and the like.

One object of this invention is to provide a device for mechanically rotating jar caps and the like.

Another object of this invention is to provide a device of the type described which has an adjustable feature so as to be adaptable to a variety of jar cap sizes.

Another object of this invention is to provide in combination a jar cap rotator, a can perforator and a bottle opener.

Another object of this invention is to provide a device of the type described which is easy to use so as to be particularly adaptable for household purposes.

These and other objects and features of the invention will become more apparent from the detailed description thereof with reference to the accompanying drawings.

DESCRIPTION OF THE INVENTION

Figure 2:
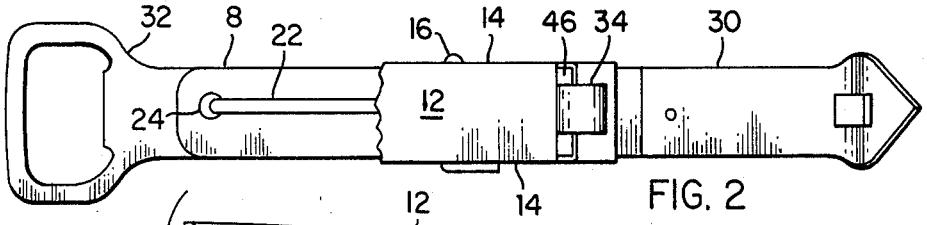
FIG. 2 is a top view, relative to FIG. 1, showing the spring biased handle feature of the invention.
Figure 1:
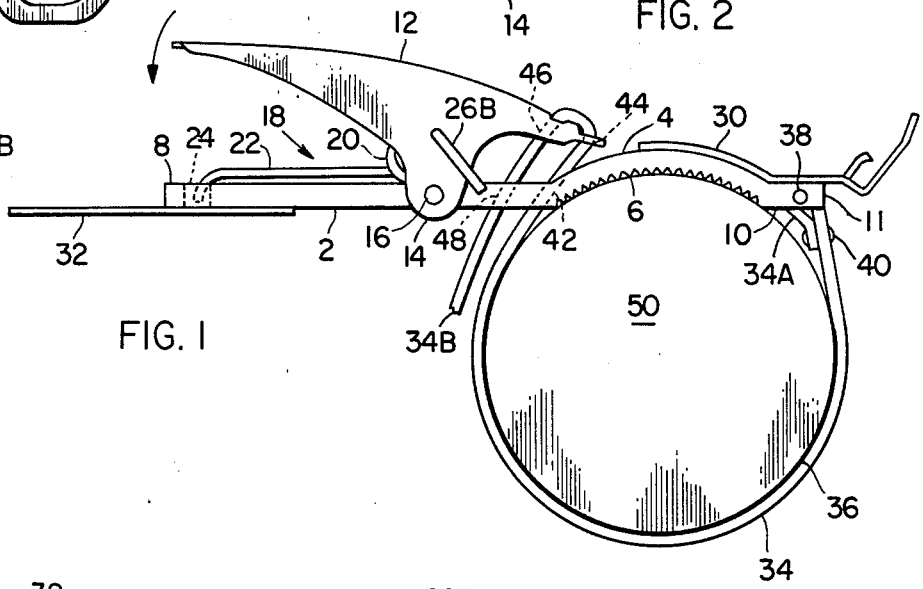
FIG. 1 is a side elevation view of the device of the invention showing said device when used for rotating a relatively large jar cap and further showing the can perforator and bottle opener.
Figure 4:
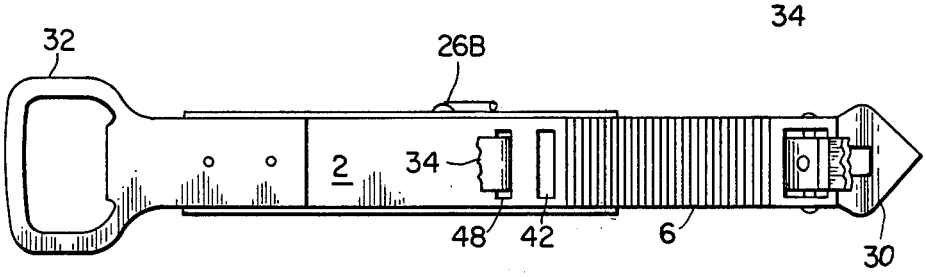
FIG. 4 is a bottom view, relative to FIG. 1, showing in particular detail the arcuate serrated base, the can perforator and the bottle opener.

With reference first to FIG. 1, there is shown a base 2 having at one end thereof an arcuate member 4 carrying suitable gripping serrations or grooves 6 on the underside thereof. Base 2 has an end 8 carrying an aperture 24 as best shown in FIG. 2 and an opposite end 10 which terminates in a lip 11 extending beyond arcuate serrated member 4.

A handle 12 straddles base 2 between ends 8 and 10 and is supported thereon through a pair of parallel arms 14 in spaced relation to each other so as to be pivotal about a pin 16 extending through base 2.

Figure 3:
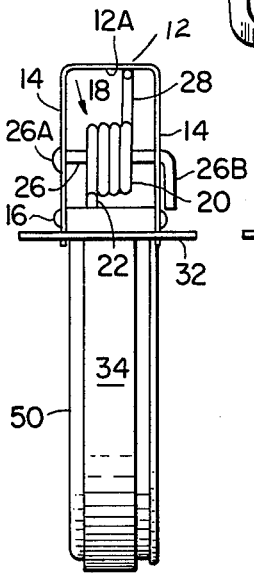
FIG. 3 is a left end view, relative to FIG. 1, showing in particular detail the spring biased handle feature of the invention.

Arm 12 is biased through a spring member designated generally by the numeral 18 in FIG. 1. Spring member 18 includes a coil portion 20 best shown in FIG. 3 and an arm portion 22 having an end received by aperture 24 so as to be retained by the base as best shown in FIG. 2. A pin 26 extends through arms 14 so as to be retained adjacent one of said arms by a head 26A and retained adjacent the other arm by a hook 26B for supporting coil portion 20 of spring 18 as best shown in FIG. 3. Coil portion 20 further includes an arm 28 which is adjacent the inside upper portion 12A of handle 12 so as to be retained thereby. Spring 20 so arranged with base 2 and handle 12 biases handle 12 away from base 2 as will now be evident.

The top side of arcuate portion 6 of base 2 supports a conventional type can perforator 30 as by rivets or welding or the like while the underside of base 2 supports a conventional bottle opener 32 as by rivets or welding or the like as best shown in FIG. 1. Perforator 30 extends beyond end 10 of base 2 and bottle opener 32 extends beyond end 8 of the base.

A flexible strap member 34 which may be of leather or like material or synthetic material has a friction or gripping surface 36. Strap 34 has an end 34A looped over a pin 38 carried on lip 11 of base 2, being secured by a rivet 40 or the like so as to thereby be captured about the pin. Strap 34, which is of indeterminant length, has a free end 34B threaded through an aperture 42 in base 2 and through an aperture 44 in handle 12 and in substantial alignment with aperture 42. Strap end 34B is looped through an aperture 46 in handle 12, said aperture 46 being in spaced relation with aperture 44, and thereupon threaded through an aperture 48 in base 2, said aperture 48 being in spaced relation with aperture 42 and in substantial alignment with aperture 46. With the arrangement as shown and described, strap 34 is adjustable so that the loop formed thereby when the free strap end is threaded through apertures 42, 44, 46 and 48 may be increased or decreased in size for surrounding the periphery of any size jar cap, with a relatively large cap such as that designated by the numeral 50 being shown in FIG. 1.

OPERATION OF THE INVENTION

In using the invention, the loop formed by strap 34 secured about pin 38 and threaded through apertures 42, 44, 46 and 48 as heretofore described is adjusted, depending upon the size of the jar cap to be rotated, by pulling free strap end 34B through the base and handle apertures in one direction or the other forming a tight loop against handle apertures 44 and 46. The jar cap, which may be of the screw type, is thus gripped by serrations 6 of arcuate member 4 and friction surface 36 of strap 34. Handle 12 is initially biased by spring 18 away from base 2 as heretofore noted. Operation of handle 12 as by squeezing against spring 18 in the direction of the arrow (FIGS. 1 and 5) renders strap 34 taut around cap 50, with the taut strap and serrations 6 cooperating to grip jar cap 50. An operator exerted torquing or twisting action has the effect of rotating the cap. Rotation in one direction loosens the cap while rotation in the opposite direction tightens the cap as may be desired.

Figure 5:
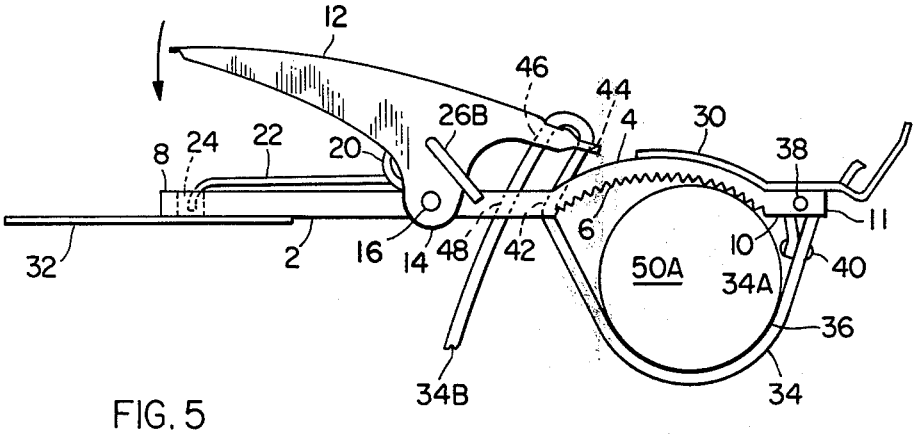
FIG. 5 is a side elevation view similar to FIG. 1, but showing the invention used for rotating a substantially smaller jar cap.

Arcuate member 4 of base 2 may be curved so as to accommodate the largest type jar cap for which use of the invention is contemplated as shown in FIG. 1. FIG. 5 shows the use of the invention with a smaller jar cap such as that designated by the numeral 50A. In this event the jar cap will be shifted in one direction or the other so as to be gripped by only a portion of serrations 6 of arcuate member 4 and to be more or less eccentrically disposed within the loop formed by strap 34. The effect of the cooperative gripping action of friction surface 36 of strap 34 and the portion of the serrations 6 will be the same as previously described with reference to FIG. 1 when spring biased handle 12 is squeezed toward base 2 so as to render the strap taut around cap 50A. Can perforator 50 and bottle opener 32 are used in the conventional manner as may be desired.

It will now be seen from the aforenoted description of the invention that a useful, practical and easy to use article has been provided. The jar cap rotating feature of the invention is adjustable so as to accommodate virtually any size jar cap. Suitable leverage is provided by the arrangement of handle 12 and the extension of base 2 carrying bottle opener 32 to provide the necessary torquing or twisting action for cap rotation. Strap 34 may be replaceable so as to increase the useful life of the device. The combination described including the jar cap rotator, the can perforator and the bottle opener enhances the utility of the invention for household purposes. Further, jar caps with or without ridges, both of which are on the market, can be accommodated by the present invention.

Although a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. A device for rotating jar caps comprising:

a base having an arcuate member at one end thereof with serrations on the underside of said member for engaging at least a portion of the jar cap;

a handle pivotally supported intermediate its ends by the base and extending toward the opposite end thereof;

means for biasing the handle away from the base at said opposite end;

a flexible member of indeterminant length having one end secured to the base at the end thereof having the arcuate member, and having another free end threaded through the base and handle adjacent said arcuate member and forward of said pivotal support for forming a loop adjustable in accordance with the periphery of the jar cap;

the flexible member having a friction surface for engaging at least part of the periphery of the jar cap and being drawn taut thereabout upon operator-operation of the handle toward the base in opposition to the biasing means; and the friction surface of the flexible member and the arcuate serrated member cooperating to grip the jar cap, with operator twisting of the device being effective for rotating said cap.

2. A device as described by claim 1, wherein:

the base includes a first aperture near the arcuate serrated member and a second aperture in spaced relation thereto away from the arcuate serrated member;

the handle includes a first aperature in substantial alignment with the first base aperture and a second aperture in spaced relation to the first aperture and in substantial alignment with the second base aperture; and the free end of the flexible member is threaded through the first base aperture and the first handle aperture, looped through the second handle aperture and threaded through the second base aperture to form the adjustable loop.

3. A device as described by claim 1, wherein the means for biasing the handle away from the base includes:

spring means having a first member retained by the handle and a second member retained by the base; and said first and second members cooperating to bias the handle away from the base.

4. A device as described by claim 3, wherein:

the handle includes a pair of parallel arms disposed in spaced relation for straddling the base and means for pivotally supporting the arms on the base;

the spring means includes a coil member supported between the arms;

one end of the coil member terminating in the first member of the spring means retained by the handle; and the other end of the coil member terminating in the second member of the spring means retained by the base.

5. A device as described by claim 4, including:

means for supporting the coil member of the spring means between the arms;

said supporting means including a pin member extending through the arms and coil member and having a first portion retained adjacent one of the arms and a second portion retained adjacent the other of said arms.

6. A device as described by claim 1, including in combination:

a bottle opener secured to one end of the base and extending therebeyond.

7. A device as described by claim 1, including in combination:

a can perforator secured to one end of the base and extending therebeyond.

8. A device as described by claim 7, wherein:

the can perforator is secured to the end of the base having the arcuate member and on the upper surface of said member.

9. A device as described by claim 8, wherein:

the bottle opener is secured to the opposite end of the base.

10. A device as described by claim 1, including in combination:

a can perforator secured to the end of the base having the arcuate serrated member, and following the upper surface of said member and extending therebeyond; and a bottle opener secured to the opposite end of the base and extending therebeyond.

* * * * *